US006191097B1

(12) United States Patent
Lueder et al.

(10) Patent No.: US 6,191,097 B1
(45) Date of Patent: Feb. 20, 2001

(54) PROCESS FOR PREPARING RAW MATERIALS FOR WASHING AGENTS

(75) Inventors: Thomas Lueder, Langenfeld; Konstantinos Scholinakis, Monheim; Bernhard Gutsche, Hilden; Christoph Breucker, Haan; Norbert Wrede, Duesseldorf, all of (DE)

(73) Assignee: Henkel Kommanditgesellschaft auf Aktien, Duesseldorf (DE)

( * ) Notice: Under 35 U.S.C. 154(b), the term of this patent shall be extended for 0 days.

(21) Appl. No.: 09/380,040

(22) PCT Filed: Feb. 17, 1998

(86) PCT No.: PCT/EP98/00891

§ 371 Date: Aug. 25, 1999

§ 102(e) Date: Aug. 25, 1999

(87) PCT Pub. No.: WO98/38278

PCT Pub. Date: Sep. 3, 1998

(30) Foreign Application Priority Data

Feb. 26, 1997 (DE) ..... 197 07 649

(51) Int. Cl.[7] ..... C11D 11/00

(52) U.S. Cl. ..... 510/444; 510/457; 510/470; 510/495; 510/501; 510/504; 159/6.3; 159/47.1

(58) Field of Search ..... 510/444, 457, 510/495, 501, 504, 470; 159/47.1, 6.3

(56) References Cited

U.S. PATENT DOCUMENTS

| | | | | |
|---|---|---|---|---|
| 4,919,846 | * | 4/1990 | Nakama et al. | 510/504 |
| 5,100,510 | * | 3/1992 | Bianchi et al. | 159/6.3 |
| 5,536,431 | * | 7/1996 | Carduck et al. | 510/444 |
| 5,780,421 | * | 7/1998 | Winstanley et al. | 510/472 |
| 5,789,535 | * | 8/1998 | Arts et al. | 528/502 R |
| 5,866,530 | * | 2/1999 | Schmid et al. | 510/438 |
| 5,900,398 | * | 5/1999 | Winstanley et al. | 510/429 |
| 6,030,937 | * | 2/2000 | Kruse et al. | 510/443 |

FOREIGN PATENT DOCUMENTS

| | | | |
|---|---|---|---|
| 195 20 105 | | 3/1996 | (DE) . |
| 19534371 | * | 2/1997 | (DE) . |
| 0 384 480 | | 8/1990 | (EP) . |
| 0 572 957 | | 12/1993 | (EP) . |
| 8 170093 | | 7/1996 | (JP) . |
| WO96/06916 | | 3/1996 | (WO) . |

OTHER PUBLICATIONS

JP 8170093 Jul. 2, 1996.
Surfactants in Consumer Products, (1987) pp. 54–124.
Katalysatoren Tenside und Mineraloladditive, (1978) pp. 123–217.
Cometics & Toilertries, vol. 104, (1989) pp.105–112.
Industrial Applications of Surfactant II, vol. 77, (1990) pp.77–100.
J.Am.Oil Chem. Soc., vol.70, (1993) pp.707–710.
Seifen–Ole–Fette–Wachse, vol.198, (1982) pp.373–376.
Happi, Nov. 1996, pp.70–75.
Tenside Detergents, vol.23, (1986) pp.309–313.
Soap/Cosmetics/Chemical Specialties, vol.46, (1990) pp.47–51.
Euro Cosmetics, vol.1, (1994) pp.14–16.

* cited by examiner

*Primary Examiner*—Lorna A. Douyon
(74) *Attorney, Agent, or Firm*—John E. Drach; Thomas F. Roland; Henry E. Millson, Jr.

(57) ABSTRACT

A process for producing solid detergent granular materials is presented involving (a) forming an aqueous surfactant paste of an anionic surfactant, an amphoteric surfactant or mixtures thereof, and (b) drying and granulating the aqueous paste in a horizontal thin-layer evaporator or dryer having rotating fittings, wherein the drying is carried out at a temperature of 120° C. to 130° C. The process produces granules having a bulk density greater than 600 grams/liter and a uniform particle size distribution.

33 Claims, No Drawings

PROCESS FOR PREPARING RAW MATERIALS FOR WASHING AGENTS

This application is filed under 35 U.S.C. 371 and based on PCT/EP98/00891, filed Feb. 17, 1998.

BACKGROUND OF THE INVENTION

1. Field of the Invention

This invention relates to a process for the contact drying of aqueous surfactant pastes in a horizontal thin-layer evaporator or dryer.

2. Discussion of Related Art

Anionic and amphoteric or zwitterionic surfactants are important ingredients of solid detergents and bar soaps. The detergents are normally produced by spraying an aqueous, generally highly alkaline slurry of the ingredients and drying the slurry with hot inert gases flowing in countercurrent. However, since this conventional spray drying process is accompanied by serious pollution of the waste air with organic material, there is a need for alternative, ecologically more favorable drying processes. These include in particular the contact drying of water-containing surfactant pastes in thin-layer dryers which leads to dry products which can then be processed with the other dried detergent ingredients, for example in mixers, to form the end product.

European patent application EP-A1 0 572 957 (Kao) describes a process for drying alkyl or alkyl ether sulfates in which dilute surfactant pastes are first concentrated to an active substance content of 60 to 80% by weight and are then dried in vacuo at temperatures of 50 to 140° C. in a vertical thin-layer evaporator. However, a major disadvantage of this process is that, because drying is carried out under reduced pressure, the end product has to be removed from the circuit using complicated equipment suitable for operation in a vacuum. The continuous contact with the hot product means that there is always a danger of caking and, hence, operational disturbances which necessitate a complete stoppage of production so that cleaning can be carried out. Another major disadvantage is that the use of a vertical thin-layer evaporator with wall contact of the rotor blades means that a flowable product film has to be maintained on the wall of the evaporator over its entire length in continuous operation in order to avoid mechanical overloading of the evaporator. Accordingly, the process is not suitable for the direct production of a powder, but only for the production of a concentrated hotmelt which has to be separately crystallized (for example in a flaking roller or the like) and then size-reduced.

By contrast, International patent application WO 96/06916 (Unilever) proposes a process for drying water-containing anionic surfactant pastes in a horizontal thin-layer evaporator which operates under a light vacuum to almost normal pressure and at temperatures above 130° C. Another feature of this process is the use of a very high peripheral speed of the stirrers used of at least 15 m/s which virtually rules out direct wall contact and leads to products of satisfactory color. However, in the drying of water-containing anionic surfactant pastes, more particularly aqueous pastes of alkyl sulfates or alkyl ether sulfates, there is basically a risk of unwanted hydrolysis in the product. Even brief reduction of the pH value leads in the presence of water to rehydrolysis, to the formation of inorganic sulfate and to a reduction in the content of washing-active substance. In following the teaching of WO 96/06916, applicants found that a hydrolysis-free product could not be reproducibly obtained over an operating period of several hours.

Accordingly, the complex problem addressed by the present invention was to provide a process for the contact drying of water-containing anionic surfactant and/or amphoteric surfactant pastes which would not have any of the disadvantages mentioned above and which, despite minimal outlay on equipment, would lead under production conditions to hydrolysis-free, free-flowing granules of satisfactory color distinguished by high bulk densities and a uniform particle size distribution.

DESCRIPTION OF THE INVENTION

The present invention relates to a process for the production of solid detergent raw materials by simultaneously drying and granulating water-containing pastes of anionic and/or amphoteric surfactants in a horizontal thin-layer evaporator or dryer with rotating fittings, characterized in that drying is carried at a temperature in the range from 120 to 130° C.

It has surprisingly been found that free-flowing granules of satisfactory color can be obtained only and precisely when the drying temperature is kept in the range mentioned. Even minor upward deviations lead to an unwanted increase in the content of inorganic sulfate while slight downward deviations lead to products with unsatisfactory flow properties. The invention includes the observation that the tendency towards hydrolysis can be further suppressed by carrying out the contact drying process in the presence of (a) 0.05 to 0.5% by weight of alkali metal carbonate and/or (b) an alkaline gas stream. The water is removed preferably by a gas stream and not by applying a vacuum. Another advantage of the process according to the invention is that it gives products of high bulk density (above 600 g/l) which, irrespective of the surfactant paste used, have a very uniform particle size distribution.

Surfactants

Typical examples of anionic surfactants which can be dried by the process according to the invention are soaps, alkyl benzenesulfonates, alkane sulfonates, olefin sulfonates, alkyl ether sulfonates, glycerol ether sulfonates, α-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products), alkyl (ether)phosphates and sulfates of ring-opening products of olefin epoxides with water or alcohols. Where the anionic surfactants contain polyglycol ether chains, they may have a conventional homolog distribution although they preferably have a narrow homolog distribution. Typical examples of amphoteric or zwitterionic surfactants are alkyl betaines, alkyl amidobetaines, aminopropionates, aminoglycinates, imidazolinium betaines and sulfobetaines. The surfactants mentioned are all known compounds. Information on their structure and production can be found in relevant synoptic works, cf. for example J. Falbe (ed.), "Surfactants in Consumer products", Springer Veriag, Berlin, 1987, pp. 54–124 or J. Falbe (ed.), "Katalysatoren, Tenside und Mineralöladditive", Thieme Verlag, Stuftgart, 1978, pp. 123–217.

In the context of the invention, water-containing pastes are understood to be aqueous preparations of the surfactants which have an active substance content of 5 to 80% by weight and preferably 10 to 70% by weight. For energy-related and rheological reasons, it is of advantage to use pastes which have a solids content of at least 30% by weight and preferably 50% by weight and at most 70% by weight. The anionic surfactants are used in the form of their alkali metal, alkaline earth metal, ammonium, alkylammonium, alkanolammonium, glucammonium salts. In other preferred embodiments of the process, alkyl and/or alkenyl (ether) sulfates, sulfosuccinates and/or betaines are dried and processed to light-colored, free-flowing granules.

Alkyl and/or Alkenyl Sulfates

In the context of the invention, alkyl and/or alkenyl sulfates, which are also often referred to as fatty alcohol sulfates, are understood to be the sulfation products of primary alcohols which correspond to formula (I):

$$R^1O—SO_3X \quad (I)$$

where $R^1$ is a linear or branched, aliphatic alkyl and/or alkenyl group containing 6 to 22 and preferably 12 to 18 carbon atoms and X is an alkali metal and/or alkaline earth metal, ammonium, alkylammonium, alkanolammonium or glucammonium. Typical examples of alkyl sulfates which may be used in accordance with the present invention are the sulfation products of caproic alcohol, caprylic alcohol, capric alcohol, 2-ethylhexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol gadoleyl alcohol, behenyl alcohol and erucyl alcohol and the technical mixtures thereof obtained by the high-pressure hydrogenation of technical methyl ester fractions or aldehydes from Roelen's oxosynthesis. In addition, Guerbet alcohols containing 16 to 32 carbon atoms may also serve as raw materials. The sulfation products may advantageously be used in the form of their alkali metal salts, especially their sodium salts. Alkyl sulfates based on $C_{16/18}$ tallow fatty alcohols or vegetable fatty alcohols with a comparable C chain distribution in the form of their sodium salts are particularly preferred.

Alkyl and/or Alkenyl Ether Sulfates

Alkyl and/or alkenyl ether sulfates ("ether sulfates") are known anionic surfactants which are industrially produced by $SO_3$ or chlorosulfonic acid (CSA) sulfation of oxoalcohol or fatty alcohol polyglycol ethers and subsequent neutralization. Ether sulfates suitable for the purposes of the invention correspond to formula (II):

$$R^2O—(CH_2CH_2O)_mSO_3X \quad (II)$$

where $R^2$ is a linear or branched alkyl and/or alkenyl group containing 6 to 22 carbon atoms, m is a number of 1 to 10 and X is an alkali and/or alkaline earth metal, ammonium, alkylammonium, alkanolammonium or glucammonium. Typical examples are the sulfates of addition products of on average 1 to 10 and, more particularly, 2 to 5 moles of ethylene oxide with caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. Adducts of ethylene oxide with Guerbet alcohols containing 16 to 32 carbon atoms may also be used as raw materials. The ether sulfates may have both a conventional homolog distribution and a narrow homolog distribution. A particularly preferred embodiment comprises using ether sulfates based on adducts of on average 2 to 3 moles of ethylene oxide with technical $C_{12/14}$ or $C_{12/18}$ cocofatty alcohol fractions in the form of their sodium and/or magnesium salts.

Sulfosuccinates

Sulfosuccinates, which are also referred to as sulfosuccinic acid esters, are known anionic surfactants which may be obtained by the relevant methods of preparative organic chemistry. They correspond to formula (III):

$$R^3(OCH_2CH_2)_pOOC—\underset{}{\overset{SO_3X}{\overset{|}{CH}}}—CH_2—COO(CH_2CH_2O)_qR^4 \quad (III)$$

where $R^3$ is an alkyl and/or alkenyl group containing 6 to 22 carbon atoms, $R^4$ has the same meaning as $R^3$ or X, p and q independently of one another stand for 0 or for numbers of 1 to 10 and X is an alkali metal or alkaline earth metal, ammonium, alkylammonium, alkanolammonium or glucammonium. They are normally produced from maleic acid, but preferably from maleic anhydride, which in a first step is esterified with optionally ethoxylated primary alcohols. The monoester-to-diester ratio can be adjusted at this stage by varying the quantity of alcohol and the temperature. The second step comprises the addition of bisulfite which is normally carried out in methanol as solvent. Fairly recent overviews of the production and use of sulfosuccinates have been published, for example, by T. Schoenberg in Cosm. Toil. 104, 105 (1989), by J. A. Milne in R. Soc. Chem. (Ind. Appl. Surf. II) 77, 77 (1990) and by W. Hreczurch et al. in J. Am. Oil. Chem. Soc. 70, 707 (1993). Typical examples are sulfosuccinic acid monoesters and/or diesters in the form of their sodium salts which are derived from fatty alcohols containing 8 to 18 and preferably 8 to 10 or 12 to 14 carbon atoms. The fatty alcohols may be etherified with on average 1 to 10 and preferably 1 to 5 moles of ethylene oxide and may have both a conventional and—preferably—a narrow homolog distribution. Di-n-octyl sulfosuccinate and monolauryl-3EO-sulfosuccinate in the form of their sodium salts are mentioned as examples.

Betaines

Betaines are known surfactants which are mainly obtained by carboxyalkylation, preferably carboxymethylation, of aminic compounds. The starting materials are preferably condensed with halocarboxylic acids or salts thereof, especially sodium chloroacetate, 1 mole of salt being formed per mole of betaine. Another suitable method is the addition of unsaturated carboxylic acids, for example acrylic acid. Information on the nomenclature and above all on the difference between betaines and "true" amphoteric surfactants can be found in the article by U. Ploog in Seifen-Öle-Fette-Wachse, 198, 373 (1982). Other overviews on this subject have been published, for example, by A. O'Lennick et al. in HAPPI, November 70 (1986), by S. Holzman et al. in Tens. Det. 23, 309 (1986), by R. Bibo et al. in Soap Cosm. Chem. Spec. Apr. 46 (1990) and by P. Ellis et al. in Euro Cosm. 1, 14 (1994). Examples of suitable betaines are the carboxy-alkylation products of secondary and, more particularly, tertiary amines corresponding to formula (IV):

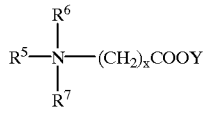

(IV)

in which $R^5$ represents alkyl and/or alkenyl groups containing 6 to 22 carbon atoms, $R^6$ represents hydrogen or alkyl groups containing 1 to 4 carbon atoms, $R^7$ represents alkyl groups containing 1 to 4 carbon atoms, x is a number of 1 to 6 and Y is an alkali metal and/or alkaline earth metal or ammonium. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine, Guerbet amines and technical mixtures thereof.

Also suitable are carboxyalkylation products of amidoamines which correspond to formula (V):

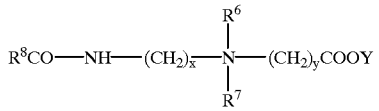

(V)

where $R^8CO$ is an aliphatic acyl group containing 6 to 22 carbon atoms and 0 or 1 to 3 double bonds, y is a number of 1 to 3 and $R^6$, $R^7$, x and Y are as defined above. Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid, erucic acid, Guerbet acids, and technical mixtures thereof, with N,N-dimethylaminoethyl amine, N,N-dimethylaminopropyl amine, N,N-diethylaminoethyl amine and N,N-diethylaminopropyl amine which are condensed with sodium chloroacetate. A condensation product of $C_{8/18}$ cocofatty acid-N,N-dimethylaminopropyl amide with sodium chloroacetate is preferably used.

Other suitable starting materials for the betaines to be used in accordance with the invention are imidazolines. These substances are also known substances which may be obtained, for example, by cyclizing condensation of 1 or 2 moles of fatty acid with polyfunctional amines, for example aminoethyl ethanolamine (AEEA) or diethylenetriamine. The corresponding carboxyalkylation products are mixtures of different open-chain betaines. Typical examples are condensation products of the above-mentioned fatty acids with AEEA, preferably imidazolines based on lauric acid or $C_{12/14}$ cocofatty acid which are subsequently betainized with sodium chloroacetate.

Alkyl and/or Alkenyl Oligoglycosides

In one particular embodiment of the invention, the anionic or amphoteric surfactants are dried together with nonionic surfactants of the alkyl and/or alkenyl oligoglycoside type which correspond to formula (VI):

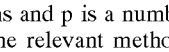

(VI)

where $R^9$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry, for example by acid-catalyzed acetalization of glucose with fatty alcohols. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (VI) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl radical $R^9$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^9$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred.

The co-drying process may be carried out by mixing and homogenizing the aqueous pastes of the various surfactants beforehand and then introducing the resulting homogenized mixture into the thin-layer evaporator. However, the pastes may also be separately introduced and mixed in situ. The ratio by weight between the anionic/amphoteric surfactants and alkyl and/or alkenyl oligoglycosides can be in the range from 10:90 to 90:10, based on the washing-active substance content, and is preferably in the range from 25:75 to 75:25. Mixtures of sulfosuccinates and alkyl oligoglucosides in a ratio by weight of 40:60 to 60:40 are particularly preferred and, after drying, are eminently suitable for the production of bar soaps.

Drying and Granulation in a Flash Dryer

The simultaneous drying and granulation are carried out in a horizontally arranged thin-layer evaporator or dryer with rotating fittings of the type marketed, for example, by the VRV Company under the name of "Flashdryer" or by the VOMM Company under the name of "Turbodryer". In simple terms, these dryers are tubes which can be heated to different temperatures over several zones. The paste-form starting material which is introduced by a pump is projected by one or more shafts equipped with blades or plowshares as rotating fittings against the heated wall on which drying takes place in the form of a thin layer typically between 1 and 10 mm thick. According to the invention, it has proved to be of advantage to apply a temperature gradient from 130 (product entry) to 20° C. (product exit) to the thin-layer evaporator. This can be done, for example, by heating the first two zones of the evaporator to 120–130° C. and cooling the last zone to 20° C. The thin-layer evaporator or dryer is operated at atmospheric pressure. Air, but preferably an alkaline gas stream, for example ammonia, is passed through in countercurrent (throughput 50 to 150 $m^3$/h). The gas entry temperature is generally in the range from 20 to 30° C. while the gas exit temperature is in the range from 90 to 110° C. The throughput of the surfactant pastes is of course dependent on the size of the dryer and amounts, for example, to between 5 and 25 kg/h. It is advisable to heat the pastes to 40 to 60° C. as they are fed into the dryer and to add alkali metal carbonate, preferably sodium carbonate, to them in quantities of 0.05 to 0.5% by weight, based on the solids content, in order to avoid hydrolysis processes.

Another preferred embodiment of the process according to the invention comprises mixing the water-containing surfactant with already dried end product on the hot contact surface. To this end, a partial stream of the product of about 10 to 40% by weight and preferably 15 to 25% by weight, based on the mass flow of the paste used, is removed at the dryer exit and directly re-introduced into the apparatus in the immediate vicinity of the paste entry point by means of a solids metering screw. It is possible by applying this measure to reduce the tackiness of the water-containing surfactant and to establish better wall contact of the product over the entire available surface. This makes product transport more uniform and intensifies drying of the product. At the same time, the particle size distribution of the granules can be shifted under control towards coarser products, i.e. the unwanted fine particle component can be significantly reduced, by the addition of the end product. This measure provides for an increase in throughput, based on analogous process conditions with no recycling of solids.

After drying, it has also proved to be of considerable advantage to transfer the granules, which still have a temperature of about 50 to 70° C., to a conveyor belt, preferably in the form of a vibrating chute or the like, and rapidly to cool them, i.e. in 20 to 60 seconds, to temperatures of around 30 to 40° C. using ambient air. In order to improve their resistance to unwanted water absorption, the granules of particularly hygroscopic surfactants may also be powdered or dusted with silica in a quantity of 0.5 to 2% by weight.

COMMERCIAL APPLICATIONS

The granules obtainable by the process according to the invention may subsequently be mixed with other ingredients of powder-form surface-active compositions, for example tower powders for detergents. The powders may also readily be incorporated in water-based preparations. In fact, there are no differences in performance properties between the powders on the one hand and the aqueous starting pastes on the other hand. The granules may readily be incorporated, for example together with fatty acids, fatty acid salts, fatty alcohols, starch, polyglycols and the like, in bar soaps of the combination bar or syndet type and toothpastes or may be used for the production of emulsifiers for emulsion polymerization.

EXAMPLES

Examples 1 to 5

The granules were produced in a flash dryer of the type manufactured by VRV S.p.A. of Milan, Italy. This dryer is a horizontally arranged thin-layer evaporator (length 1100 mm, internal diameter 155 mm) with 4 shafts and 22 blades which are arranged at a distance of 2 mm from the wall. The dryer has three separate heating and cooling zones and a total heat-exchange surface of 0.44 $m^2$. It is operated at normal pressure. Water-containing surfactant pastes (solids content 70% by weight) optionally containing 1% by weight of sodium carbonate as additive and heated to 50° C. were pumped by a vibrating pump (throughput 11.5 kg/h) into the thin-layer evaporator in which heating zones 1 and 2 had been adjusted to 125° C. and cooling zone 3 to a temperature of 20° C. The speed of the rotors was 24 m/s. Air or a 1:1 mixture of air and ammonia was passed through the flash dryer (ca. 110 $m^3$/h). The gas exit temperature was ca. 65° C. The predried granules, which still had a temperature of about 60° C., were transferred to a vibrating chute (length 1 m), exposed to ambient air and cooled in 30 seconds to a temperature of around 40° C. The granules were then dusted/powdered with about 1% by weight of silica (Sipernat® 50 S). Dry, pure white granules were obtained and remained free flowing, i.e. did not form any lumps, even after prolonged storage in air. The characteristic data of the granules are set out in Table 1.

TABLE 1

Characteristic data of the flash dryer granules (percentages = % by weight)

| Ex. | Surfactant paste | Particle size distribution [%] in mm >0.8 | >0.4 | >0.2 | >0.1 | <0.1 | RW [%] | BD [g/l] |
|---|---|---|---|---|---|---|---|---|
| 1 | Sodium Lauryl Sulfate[1)] | 11.1 | 19.0 | 24.2 | 31.0 | 14.7 | 1.3 | 610 |
| 2 | Sodium Laureth Sulfate[1)] | 11.8 | 21.0 | 26.3 | 35.5 | 5.4 | 1.2 | 615 |
| 3 | Sodium Laureth Sulfo-succinate[2)] | 12.0 | 13.4 | 27.1 | 34.0 | 13.5 | 1.3 | 620 |
| 4 | Cocoamido-propyl Betaine | 12.2 | 12.7 | 23.5 | 33.7 | 17.9 | 1.3 | 610 |
| 5 | Sodium Laureth Sulfo-succinate/ Coco Glucosides (1:1)[2)] | 11.9 | 12.5 | 22.9 | 32.7 | 20.0 | 1.3 | 600 |

[1)]Addition of sodium carbonate to the paste, air/ammonia gas stream
[2)]Addition of sodium carbonate to the paste
RW = Residual water content of the granules
BD = Bulk density

Examples 6 to 11

Alkyl sulfate pastes were dried in the same way as described in Example 1 except that a partial product stream (Examples 7, 8 and 11) was removed at the dryer exit and directly returned to the dryer in the immediate vicinity of the paste entry point by means of a solids metering screw. The results are set out in Table 2.

TABLE 2

Drying of AS pastes with recycling (percentages = % by weight)

| Parameter | 6 | 7 | 8 | 9 | 10 | 11 |
|---|---|---|---|---|---|---|
| Starting material | 1 | 1 | 1 | 2 | 2 | 2 |
| Drying temperature [° C.] | | | 128 | | | |
| Flow rate of paste [kg/h] | 8.5 | 11.5 | 13.5 | 8.5 | 11.3 | 11.3 |
| Flow rate of solids [kg/h] | — | 3.5 | 1.7 | — | — | 1.7 |
| Water content of end product [%] | 0.4 | 0.4 | 0.4 | 0.7 | 1.3 | 1.0 |
| Bulk density [g/l] | 557 | | 593 | 654 | | 657 |
| Particle size distribution [%] | | | | | | |
| >0.8 mm | 11.1 | | 29.4 | 0.8 | | 0.7 |
| >0.4 mm | 19.0 | | 30.2 | 3.0 | | 9.1 |
| >0.2 mm | 24.2 | | 23.9 | 7.2 | | 19.7 |
| >0.1 mm | 31.0 | | 13.1 | 32.2 | | 45.7 |
| <0.1 mm | 14.7 | | 3.4 | 56.8 | | 24.8 |

[1]Cocoalkyl sulfate sodium salt, 35% by weight active substance
[2]Lauryl sulfate sodium salt, 35% by weight active substance Examples 6 to 8 show that, for the same water content of the end product, the throughput of paste was increased from 8.5 to 13.5 kg/h when the powder was recycled. The quantity recycled can be varied within wide limits (Examples 7 and 8). The product of Example 8 is much coarser than the product of Example 1. Examples 9 and 10 show that an increase in throughput without any recycling of powder can lead to an increase in the water content of the product from 0.7 to 1.3% by weight. Recycling of the powder (Example 11) reduced product moisture and again led to powders with a smaller dust content.

What is claimed is:

1. A process for producing solid detergent granules comprising simultaneously drying and granulating an aqueous surfactant paste comprising an anionic surfactant, an amphoteric surfactant or mixtures thereof in the presence of at least one of (a) from 0.05 to 1% by weight of an alkali metal carbonate, and (b) an alkaline gas stream, in a horizontal thin-layer evaporator or dryer having rotating fittings, wherein the drying is carried out at a temperature of from 120° C. to 130° C. and at atmospheric pressure.

2. The process of claim 1 wherein the surfactant is selected from the group consisting of soaps, alkyl benzenesulfonates, alkane sulfonates, olefin sulfonates, alkyl ether sulfonates, glycerol ether sulfonates, alpha-methyl ester sulfonates, sulfofatty acids, alkyl sulfates, alkenyl sulfates, alkyl ether sulfates, alkenyl ether sulfates, glycerol ether sulfates, hydroxy mixed ether sulfates, monoglyceride sulfates, monoglyceride ether sulfates, fatty acid amide sulfates, fatty acid amide ethersulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids, alkyl oligoglucoside sulfates, protein fatty acid condensates, alkyl phosphates, alkyl etherphosphates, alkyl betaines, alkyl amidobetaines, aminopropionates, aminoglycinates, imidazolinium betaines and sulfobetaines.

3. The process of claim 2 wherein the alkyl or alkenyl sulfate corresponds to formula (I):

$$R^1O—SO_3X \quad (I)$$

wherein $R^1$ is a linear or branched, aliphatic alkyl or alkenyl group containing 6 to 22 carbon atoms and X is an alkali metal, alkaline earth metal, ammonium, alkylammonium, alkanolammonium or glucammonium.

4. The process of claim 3 wherein $R^1$ is a linear or branched, aliphatic alkyl or alkenyl group containing 12 to 18 carbon atoms.

5. The process of claim 2 wherein the alkyl ether sulfate corresponds to formula (II):

$$R^2O—(CH_2CH_2O)_mSO_3X \quad (II)$$

wherein $R^2$ is a linear or branched alkyl or alkenyl group containing 6 to 22 carbon atoms, m is a number of 1 to 10 and X is an alkali metal, alkaline earth metal, ammonium, alkylammonium, alkanolammonium or glucammonium.

6. The process of claim 2 wherein the sulfosuccinate corresponds to formula (III):

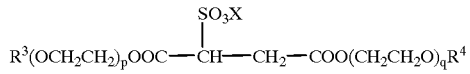

(III)

wherein $R^3$ is an alkyl or alkenyl group containing 6 to 22 carbon atoms, $R^4$ has the same meaning as $R^3$ or X, p and q independently of one another stand for 0 or for numbers of from 1 to 10 and X is an alkali metal, alkaline earth metal, ammonium, alkylammonium, alkanolammonium or glucammonium.

7. The process of claim 2 wherein the betaine corresponds to formula (IV):

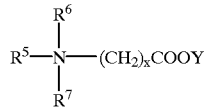

(IV)

wherein $R^5$ represents alkyl or alkenyl groups containing 6 to 22 carbon atoms, $R^6$ represents hydrogen or alkyl groups containing 1 to 4 carbon atoms, $R^7$ represents an alkyl group containing 1 to 4 carbon atoms, x is a number of 1 to 6 and Y is an alkali metal, alkaline earth metal or ammonium.

8. The process of claim 2 wherein the betaine corresponds to formula (V):

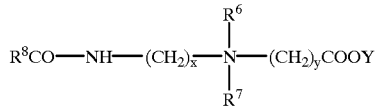

(V)

wherein $R^8CO$ is an aliphatic acyl group containing 6 to 22 carbon atoms and 0 to 3 double bonds, y is a number of 1 to 3, $R^6$ represents hydrogen or alkyl groups containing 1 to 4 carbon atoms, $R^7$ represents an alkyl group containing 1 to 4 carbon atoms, x is a number of 1 to 6 and Y is an alkali metal, alkaline earth metal or ammonium.

9. The process of claim 1 comprising removal of water by a gas stream.

10. The process of claim 9 wherein said gas stream comprises an alkaline gas stream.

11. The process of claim 1 wherein the alkali metal carbonate is present in the aqueous paste.

12. The process of claim 1 wherein the solid detergent granules have a bulk density of greater than 600 grams per liter.

13. The process of claim 1 wherein the aqueous surfactant paste comprises 5 to 80 percent by weight of active substance.

14. The process of claim 13 wherein the aqueous surfactant paste comprises 10 to 70 percent by weight of active substance.

15. The process of claim 1 wherein the aqueous surfactant paste comprises at least 30 percent by weight of solids.

16. The process of claim 15 wherein the aqueous surfactant paste comprises at least 50 percent by weight of solids.

17. The process of claim 16 wherein the aqueous surfactant paste comprises up to 70 percent by weight of solids.

18. The process of claim 1 wherein the aqueous surfactant paste further comprises an alkyl or alkenyl oligoglycoside nonionic surfactant, or mixtures thereof.

19. The process of claim 18 wherein the ratio of anionic and amphoteric surfactant to alkyl and alkenyl oligoglycoside is from 10:90 to 90:10 by weight based on the active substance.

20. The process of claim 19 wherein the ratio of anionic and amphoteric surfactant to alkyl and alkenyl oligoglycoside is from 25:75 to 75:25 by weight based on the active substance.

21. The process of claim 18 wherein the aqueous surfactant paste comprises a sulfosuccinate and an alkyl oliogluc oside in the ratio of 40:60 to 60:40 by weight based on the active substance.

22. The process of claim 1 further comprising heating the aqueous paste to 40° C. to 60° C. prior to introduction into the dryer or evaporator.

23. The process of claim 1 further comprising back-mixing dried end-product with the aqueous surfactant paste prior to drying and granulation.

24. The process of claim 23 comprising back-mixing with said aqueous surfactant paste from 10 to 40 percent by weight of dried end-product based on the mass of the aqueous surfactant paste.

25. The process of claim 24 comprising back-mixing with said aqueous surfactant paste from 15 to 25 percent by weight of dried end-product based on the mass of the aqueous surfactant paste.

26. The process of claim 1 further comprising transferring the dry solid detergent granules to a conveyor belt, wherein the temperature of said solid detergent granules is from 50° C. to 70° C., and rapidly cooling said granules to temperatures of 30° C. to 40° C. using ambient air.

27. The process of claim 26 wherein the solid detergent granules are cooled from 50° C. to 70° C. down to 30° C. to 40° C. in 20 to 60 seconds.

28. A process for producing solid detergent granules comprising the steps of A) introducing an aqueous paste comprising an anionic surfactant, an amphoteric surfactant, or mixtures thereof into a horizontal thin-layer evaporator or dryer having rotating fittings;

B) simultaneously drying and granulating the aqueous paste at a temperature in the range of 120 to 130° C. in the presence of at least one of (a) from 0.05 to 0.5% by weight of an alkali metal carbonate, and (b) an alkaline gas stream, wherein the drying process is carried out at atmospheric pressure and water is removed by a stream of gas; and C) removing the resulting dry solid detergent granules from the evaporator or dryer.

29. The process of claim 28 wherein the aqueous paste is heated to a temperature of from 40 to 60° C. prior to step A).

30. The process of claim 28 wherein following step B) the resulting dry solid detergent granules at a temperature of 50 to 70° C. are transferred to a conveyor belt and rapidly cooled to a temperature of 30 to 40° C. using ambient air.

31. The process of claim 28 wherein from 10 to 40% by weight of the resulting dry solid detergent granules removed in step C) are reintroduced into the horizontal thin-layer evaporator or dryer.

32. The process of claim 31 wherein said percentage is from 15 to 25% by weight.

33. The process of claim 28 wherein in step B) an alkaline gas stream is employed.

* * * * *